US010030207B2

(12) United States Patent
Mori et al.

(10) Patent No.: US 10,030,207 B2
(45) Date of Patent: Jul. 24, 2018

(54) SLIDING MACHINE

(71) Applicants: TOYOTA JIDOSHA KABUSHIKI KAISHA, Toyota-shi, Aichi-ken (JP); KABUSHIKI KAISHA TOYOTA CHUO KENKYUSHO, Nagakute-shi, Aichi-ken (JP)

(72) Inventors: Hiroyuki Mori, Nagakute (JP); Mamoru Tohyama, Nagakute (JP); Masaru Okuyama, Nagakute (JP); Keiji Hayashi, Nagoya (JP); Naoya Ikeda, Toyota (JP)

(73) Assignees: TOYOTA JIDOSHA KABUSHIKI KAISHA, Toyota-shi, Aichi-ken (JP); KABUSHIKI KAISHA TOYOTA CHUO KENKYUSHO, Nagakute-shi, Aichi-ken (JP)

( * ) Notice: Subject to any disclaimer, the term of this patent is extended or adjusted under 35 U.S.C. 154(b) by 0 days.

(21) Appl. No.: 14/795,388

(22) Filed: Jul. 9, 2015

(65) Prior Publication Data

US 2016/0010021 A1 Jan. 14, 2016

(30) Foreign Application Priority Data

Jul. 11, 2014 (JP) ..... 2014-143309

(51) Int. Cl.
*C10M 125/22* (2006.01)

(52) U.S. Cl.
CPC .... *C10M 125/22* (2013.01); *C10M 2201/066* (2013.01); *C10N 2210/06* (2013.01); *C10N 2230/06* (2013.01); *C10N 2230/40* (2013.01); *C10N 2230/42* (2013.01); *C10N 2230/43* (2013.01); *C10N 2280/00* (2013.01)

(58) Field of Classification Search
CPC ..... C10M 125/22; C10M 2201/066; C10N 2210/06; C10N 2230/06; C10N 2230/40; C10N 2230/42; C10N 2230/43; C10N 2280/00
USPC ..... 508/108
See application file for complete search history.

(56) References Cited

U.S. PATENT DOCUMENTS

2005/0119136 A1* 6/2005 Castle ..... C10M 135/18 508/363
2007/0060483 A1 3/2007 Konishi et al.
2011/0021390 A1 1/2011 Mori et al.
2013/0129264 A1 5/2013 Watanabe et al.
2013/0252860 A1* 9/2013 Komori ..... C10M 141/10 508/108
2014/0128298 A1 5/2014 Becker et al.

FOREIGN PATENT DOCUMENTS

| | | | | |
|---|---|---|---|---|
| CN | 1532269 | A | 9/2004 | |
| CN | 103486043 | A | 1/2014 | |
| EP | 1 462 508 | A1 | 9/2004 | |
| EP | 1462508 | A1 | 9/2004 | |
| EP | 1661971 | A1 | 5/2006 | |
| JP | 2001-316686 | A | 11/2001 | |
| JP | 2004-10923 | A | 1/2004 | |
| JP | 2004-115826 | A | 4/2004 | |
| JP | 2004-339486 | A | 12/2004 | |
| JP | 2008-81630 | A | 4/2008 | |
| JP | 2011-252073 | A | 12/2011 | |
| JP | 2014-224239 | A | 12/2014 | |
| WO | 2005/014763 | A1 | 2/2005 | |
| WO | WO 2012116818 | A1 * | 9/2012 | ..... C23C 14/021 |

OTHER PUBLICATIONS

Sun, J., Fu, Z.-Q., Zhang, W., Wang, C.-B., Yue, W., Lin, S.-S., and Dai, M.-J., "Friction and wear of Cr-doped DLC films under different lubrication conditions", Vacuum, 94, 2013, pp. 1-5.*
Tasdemir, H.A., Tokoroyama, T., Kousaka, H., Umehara, N., and Mabuchi, Y., "Friction and wear performance of boundary-lubricated DLC/DLC contacts in synthetic base oil", Procedia Engineering, 68, 2013, pp. 518-524).*

* cited by examiner

*Primary Examiner* — James Goloboy
(74) *Attorney, Agent, or Firm* — Sughrue Mion, PLLC

(57) ABSTRACT

A sliding machine includes: a pair of sliding members having sliding surfaces that oppose each other and are able to move relative to each other; and a lubricating oil which is able to be interposed between the opposed sliding surfaces, in which at least one of the sliding surfaces is covered with a chromium (Cr)-containing amorphous carbon film (chromium-coating DLC), and the lubricating oil contains an oil-soluble molybdenum compound having a chemical structure formed from a trinuclear material of molybdenum (Mo). Specifically, the chromium-coating DLC contains, when the entirety of the film is assumed to be 100 at. %, 1% to 49% of Cr, 0% to 30% of hydrogen (H), carbon (C) as a remainder, and impurities. The lubricating oil contains 5 ppm to 800 ppm of the oil-soluble molybdenum compound in terms of Mo mass ratio with respect to the entirety of the lubricating oil.

4 Claims, 8 Drawing Sheets

R = hydrocarbyl

TRINUCLEAR Mo MATERIAL(Mo-Trinuclear)

SLIDING MACHINE

INCORPORATION BY REFERENCE

The disclosure of Japanese Patent Application No. 2014-143309 filed on Jul. 11, 2014 including the specification, drawings and abstract is incorporated herein by reference in its entirety.

BACKGROUND OF THE INVENTION

1. Field of the Invention

The present invention relates to a sliding machine capable of significantly reducing friction coefficient, sliding resistance, and the like that are applied between sliding surfaces using a combination of an amorphous carbon film containing chromium (Cr) which is a specific element (chromium-containing DLC film), and a lubricating oil containing an oil-soluble molybdenum compound having a specific chemical structure.

2. Description of Related Art

Many machines have sliding members which move relative to each other while coming into sliding contact with each other. In such machines having sliding members (in the specification, referred to as "sliding machines"), by reducing resistance (sliding resistance) applied to the sliding parts, performance is enhanced and energy necessary for operations is reduced. The reduction in the sliding resistance is typically achieved by a reduction in the friction coefficient of friction applied between sliding surfaces.

The friction coefficient of friction applied between the sliding surfaces varies depending on the surface states of the sliding surfaces and the lubricating state between the sliding surfaces. Therefore, in order to achieve the reduction in the friction coefficient, the surface modification of the sliding surfaces and the improvement of a lubricant (lubricating oil) supplied between the sliding surfaces are considered. There are various methods for the surface modification of the sliding surfaces. However, in many cases, an amorphous carbon film (a so-called diamond-like carbon (DLC) film) which achieves a reduction in the degree of friction and has excellent wear resistance is formed on the sliding surfaces. In addition, the lubricant is also improved in various ways depending on the type of sliding machine, use environment, and the like, and typically, the improvement may correspond to mixing an additive which is effective in reducing friction.

However, the DLC film which is considered to be effective in reducing friction varies in property between a dry type and a wet type. Moreover, the sliding property of the DLC film in the wet type varies depending on the type of the applied lubricating oil. Here, an optimal combination of a specific DLC film and a specific lubricating oil is important to achieve a reduction in the friction coefficient. Suggestions related to this are, for example, the following patents.

Japanese Patent Application Publication No. 2001-316686 (JP 2001-316686 A) suggests a combination of a DLC film containing Mo or Ti and a lubricating oil containing 500 ppm of molybdenum dithiocarbamate (MoDTC). In addition, WO2005/14763 suggests a combination of a general DLC film which does not contain metal elements and the like and a lubricating oil which contains a sulfur-containing molybdenum complex (MoDTC) in a proportion of 9.9 mass % in terms of Mo content. The MoDTC used in JP 2001-316686 A and WO2005/14763 is an additive of a well-known engine oil and is made of binuclear molybdenum. Japanese Patent Application Publication No. 2011-252073 (JP 2011-252073 A) suggests a combination of a lubricant which contains an organic molybdenum compound instead of the MoDTC, in which the mass ratio (N/Mo) of nitrogen and molybdenum is in a predetermined range, and a H (20%)-containing DLC film.

Japanese Patent Application Publication No. 2004-339486 (JP 2004-339486 A) (EP Patent No. EP1462508B1) suggests a combination of a general DLC film which does not include metal elements and the like and a lubricating oil in which trinuclear molybdenum dithiocarbamate is added to base oil in a proportion of 550 ppm in terms of Mo content. However, in JP 2004-339486 A (EP Patent No. EP1462508B1), only the intent that the friction coefficient is reduced by the combination is described, and the mechanism is not clarified at all. In addition, the friction coefficient obtained by the combination is only about 0.1, and the reduction in the friction coefficient is still insufficient.

As described above, although suggestions for a reduction in the friction coefficient using an appropriate combination of a DLC film and a lubricating oil have been provided hitherto, the suggestions do not achieve a significant reduction in the friction coefficient. In addition, mechanisms of changing the friction coefficient using the combination of a DLC film and a lubricating oil, and the like are not clarified yet.

SUMMARY OF THE INVENTION

The present invention has been made taking the foregoing circumstances into consideration, and an object thereof is to provide a sliding machine using a new combination of a DLC film and a lubricating oil, the sliding machine being capable of significantly reducing at least the friction coefficient between sliding surfaces, as compared to the related art.

The inventors intensively studied to solve the problems and underwent trial and error. As a result, it was found that the friction coefficient of friction between sliding surfaces is significantly reduced by a new combination of an amorphous carbon film containing chromium (Cr) and a lubricating oil containing an oil-soluble molybdenum compound having a specific chemical structure. Moreover, it was seen that an excellent low friction property and wear resistance are compatible with each other. By developing this achievement, the present invention that will be described below was completed.

Sliding Machine (1) A sliding machine of the present invention includes a pair of sliding members having sliding surfaces that oppose each other and are able to move relative to each other; and a lubricating oil which is able to be interposed between the opposed sliding surfaces, in which at least one of the sliding surfaces is formed of a covered surface covered with an amorphous carbon film containing chromium (Cr), the lubricating oil contains an oil-soluble molybdenum compound having a chemical structure formed from a trinuclear material of molybdenum (Mo).

(2) By combining the sliding surface coated with the amorphous carbon film containing Cr (appropriately referred to as "chromium-containing DLC film" or simply referred to as "DLC film") and the lubricating oil containing the oil-soluble molybdenum compound having a specific chemical structure, a sliding machine in which the friction coefficient of friction between sliding surfaces is significantly reduced is obtained. Specifically, an ultralow friction property in which the friction coefficient is 0.05 or lower, 0.04 or lower, or about 0.03 can be exhibited. As a result, the sliding machine of the present invention can significantly reduce sliding resistance or friction loss and this can achieve significant enhancement in movement performance, energy saving, and the like. Furthermore, the chromium-containing DLC film according to the present invention can also exhibit excellent wear resistance in addition to the low friction property. Therefore, the sliding machine of the present invention is particularly appropriate for a driving system machine (for example, an engine, or a transmission) which is operated for a long period of time under severe conditions from boundary lubrication conditions to mixed-lubrication conditions.

(3) Although the mechanism in which a combination of a specific DLC film according to the present invention and the lubricating oil exhibits an extremely excellent friction reducing effect is not necessarily clear, the inventors intensively studied, and the following is considered in the present circumstances.

In the case of the DLC film according to the present invention, an adsorption reaction of the oil-soluble molybdenum compound (appropriately referred to as "trinuclear Mo compound" or simply referred to as "trinuclear Mo material") formed from trinuclear materials of Mo contained in the lubricating oil is accelerated in a part where Cr is present. As a result, other additives which have a competitive adsorption relationship with the trinuclear Mo compound, or the constituent elements thereof perform a suppressed adsorption reaction on the sliding surface (the DLC film).

For example, when the trinuclear Mo compound is absent, additives such as overbased calcium sulfonate which is widely added to lubricating oils adsorb onto the sliding surface and may generate maldistributed reaction compounds having a thickness (height) of greater than 5 nm such that fine convex portions (protrusions) may be formed on the sliding surface. Such fine convex portions are the cause of an increase in the friction coefficient during boundary lubrication (or during mixed-lubrication).

However, in the sliding machine of the present invention, as described above, the chromium-containing DLC film and the lubricating oil containing the trinuclear Mo compound are synergically operated. As a result, the adsorption of other additives onto the sliding surface is impeded, and thus a situation in which the surface roughness of the sliding surface is increased is avoided. Accordingly, the sliding surface according to the present invention can become a super-smooth surface (for example, the surface roughness (maximum height) is 5 nm or lower or 2 nm or lower) on which fine convex portions generated by the adsorption of other additives are rarely formed, as long as the DLC film and the lubricating oil sufficiently come into contact with each other at least after the sliding machine makes a trial run or the like. It is thought that since the smooth sliding surfaces move relative to each other with an oil film formed of the lubricating oil interposed therebetween, fine direct contact between the sliding surfaces is avoided, the fluid lubricating state is easily maintained, and thus the friction coefficient of friction between the sliding surfaces is significantly reduced.

Furthermore, the chromium-containing DLC film according to the present invention is typically harder than the base material (for example, steel) of the sliding member and has a property of being less likely to move and adhere to the sliding surface on the counter slider side. In addition, unlike the DLC film containing other metal elements (W, V, Al, and the like), in the chromium-containing DLC film, hard CrC is finely dispersed in matrix-like DLC and thus the chromium-containing DLC film is likely to have a high hardness. As a result, the sliding machine of the present invention exhibits high wear resistance as well as a low friction property in the presence of the above-described lubricating oil, and thus can stably exhibit an excellent sliding property (a low friction property) for a long period of time.

In addition, since the trinuclear Mo compound according to the present invention adsorbs onto the sliding surface, molybdenum sulfide compounds having a chemical structure such as $Mo_3S_7$, $Mo_3S_8$, and $Mo_2S_6$ can be formed on the sliding surface. It is estimated that such as molybdenum sulfide compounds have a similar structure to that of molybdenum disulfide ($MoS_2$), and thus exhibit a low shear property based on a layered structure between the sliding surfaces like molybdenum disulfide. As a result, direct contact between the sliding surfaces is avoided, and thus the friction coefficient of boundary friction can also be reduced. It is thought that this also macroscopically contributes to a reduction in the friction coefficient.

(4) In the chromium-containing DLC film of the present invention, a various composition can be taken, however, the film may contain, for example, when the entirety of the film is assumed to be 100 at. % (simply referred to as "%"), 1% to 49% of Cr, 0% to 30% of hydrogen (H), and carbon (C) and impurities as a remainder. In addition, the chromium-containing DLC film according to the present invention does not necessarily need to contain H as long as Cr is contained and may also be an H-free (an H content of 3% or lower or 2% or lower) DLC film in which H is not substantially contained, or may also be a low-hydrogen DLC film (DLC-low-H film) having an H content of 3% to 10% or 5% to 8%. As a matter of course, the DLC film according to the present invention may also contain an appropriate amount of H (an H content of 10% to 30% or 15% to 28%).

(5) In the trinuclear Mo material of the present invention, the material may be formed, for example, from $Mo_3S_7$ or $Mo_3S_8$, and particularly, $Mo_3S_7$ As long as the trinuclear Mo compound according to the present invention has a skeleton (molecular structure) formed from the trinuclear material, the trinuclear Mo compound may have any functional group bonded to the end thereof or any molecular weight. For reference, an example of the molybdenum sulfide compound formed from $Mo_3S_7$ is shown in FIG. 8. R in FIG. 8 is a hydrocarbyl group.

Others (1) For the "sliding machine" described in the present invention, the sliding member and the lubricating oil are enough, and the sliding machine is not limited to a machine as a final product, and may also be a combination of mechanical elements forming a portion of the machine, or the like. Therefore, the sliding machine of the present invention can also be mentioned as a sliding structure, a sliding system, or the like.

The covered surface formed of the DLC film according to the present invention may be formed on at least one of the sliding surfaces of the sliding members that oppose each other and move relative to each other. As a matter of course, it is more preferable that both the sliding surfaces have the covered surfaces formed of the DLC film.

(2) Unless otherwise specified, "x to y" mentioned in the specification includes a lower limit x and an upper limit y. Various numerical values described in the specification and arbitrary numeral values included in a numerical value range may be set to a new lower limit or a new upper limit so that ranges such as "a to b" can be established.

BRIEF DESCRIPTION OF THE DRAWINGS

Features, advantages, and technical and industrial significance of exemplary embodiments of the invention will be described below with reference to the accompanying drawings, in which like numerals denote like elements, and wherein.

DETAILED DESCRIPTION OF EMBODIMENTS

Figure 1:
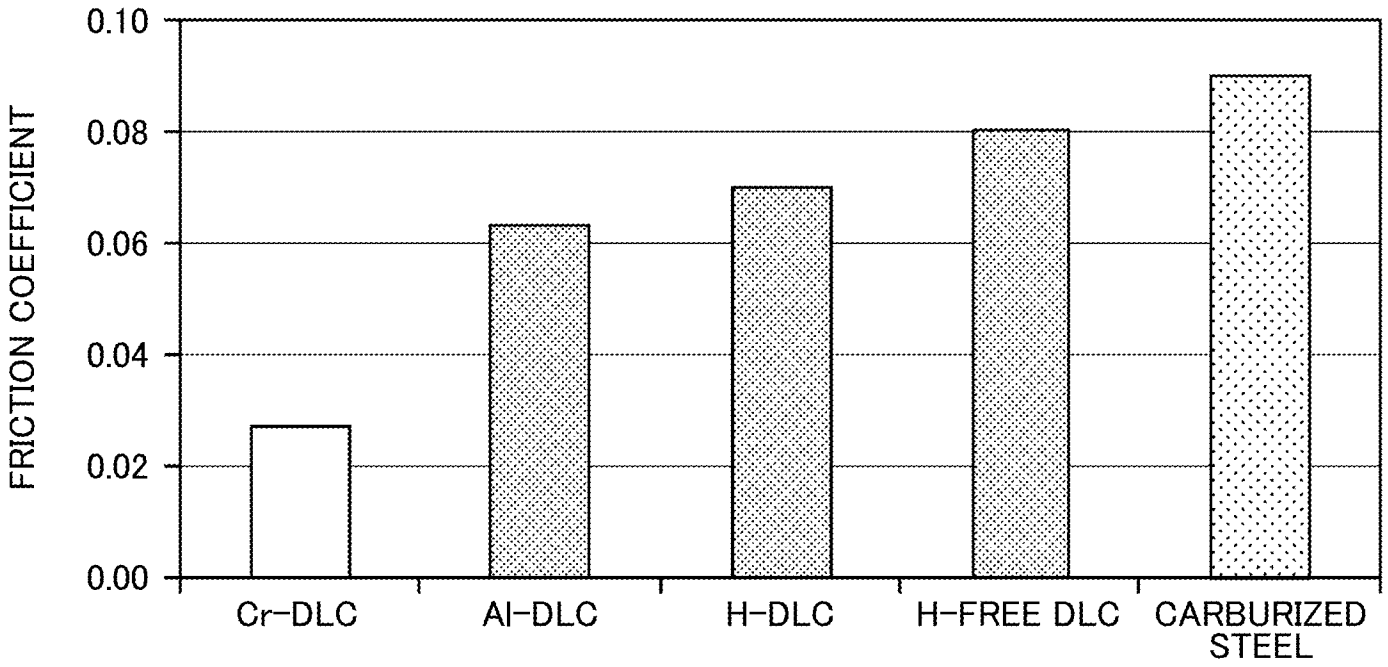
FIG. 1 is a bar graph showing the friction coefficient of each test material in a case where a lubricating oil containing a trinuclear Mo compound is used.

One or two or more constituent elements which are arbitrarily selected from the specification can be added to the above-described constituent elements of the present invention. Contents described in the specification appropriately correspond to not only the entirety of a sliding machine of the present invention but also a sliding member and a lubricating oil included therein, and may also be methodological constituent elements or constituent elements regarding materials. Which embodiment is optimal depends on the object, required performance, and the like.

Lubricating Oil

A lubricating oil according to the present invention is not dependent on the type of base oil, the absence or presence of other additives, or the like as long as the lubricating oil contains a trinuclear Mo compound. Typically, a lubricating oil such as an engine oil contains various additives including S, P, Zn, Ca, Mg, Na, Ba, and Cu. Among the types of lubricating oils, the trinuclear Mo compound according to the present invention preferentially acts on a sliding surface (covered surface) covered with a DLC film and suppresses the generation of a compound that may deteriorate the surface roughness of the covered surface through an adsorption reaction or the like due to other added elements. In addition, the lubricating oil according to the present invention may also contain Mo-based compounds (for example, MoDTC, molybdenum disulfide, and the like) other than the trinuclear Mo compound. However, since Mo is a type of rare metal, it is preferable that the sum of the contained Mo is as low as possible.

When too small an amount of the trinuclear Mo compound is contained, the above-described effect is not easily exhibited. However, there is no problem when too large an amount of the trinuclear Mo compound is contained. However, as described above, it is preferable that the amount of Mo being used is as low as possible. Here, it is preferable that the trinuclear Mo compound according to the present invention is contained in a proportion of 5 ppm to 800 ppm, 10 ppm to 500 ppm, 40 ppm to 200 ppm, or 60 ppm to 100 ppm in terms of the mass ratio of Mo to the entire lubricating oil. When the mass ratio of Mo to the entire lubricating oil is represented by ppm, the mass ratio thereof is designated by ppm Mo. Furthermore, even in a case where the Mo-based compounds and the like other than the trinuclear Mo compound are contained in the lubricating oil, it is preferable that the upper limit of the total amount of Mo with respect to the entire lubricating oil is 400 ppm Mo to 300 ppm Mo.

Sliding Surface of Sliding Member

The sliding member according to the present invention may have any type, form, or sliding form as long as the sliding member has sliding surfaces which move relative to each other with the lubricating oil interposed therebetween. In the case of the present invention, at least one of a pair of sliding surfaces which oppose each other and move relative to each other is coated with a chromium-containing DLC film, the friction coefficient of friction between the sliding surfaces can be significantly reduced due to combination with the lubricating oil. Particularly, by matching the DLC film and the composition of the lubricating oil, the sliding machine of the present invention can exhibit an ultralow friction property in which the friction coefficient of friction between the sliding surfaces is 0.04 or lower or near 0.03.

The reason that a significantly low friction property is exhibited as described above is that, in a situation in which the lubricating oil containing the trinuclear Mo compound is present, the sliding surface (covered surface) coated with the chromium-containing DLC film comes into sliding contact with the opposing sliding surface and thus the surface shape (surface roughness) of the covered surface enters a very smooth state. The degree of smoothness of the covered surface changes with the type of the DLC film or the lubricating oil, sliding conditions, and the like, and the surface roughness thereof when measured by scanning a rectangular measurement area of, for example, 1 μm×1 μm in a direction perpendicular to the sliding direction with an atomic force microscope may be 8 nm or lower, 5 nm or lower, or 2 nm or lower, in terms of maximum height (Rmax). Furthermore, the covered surface according to the present invention may have a surface roughness Rmax in the above range even when the measurement area is enlarged to 10 μm×10 μm.

The reason that such a significantly flat surface is formed is that, as described above, the trinuclear Mo compound contained in the lubricating oil impedes the generation of compounds that may deteriorate the surface roughness of the covered surface. Examples of the added elements that generate such compounds include Ca which is widely contained in a cleaning agent or the like of an engine oil. The ratio (presence ratio) of $Mo_3S_7$ which has a representative chemical structure that forms a trinuclear Mo material with Ca and is present on the covered surface was examined, and it was apparent that $Mo_3S_7$ correlates with the friction coefficient of friction between sliding surfaces. Specifically, it was seen that when the outermost surface of the covered surface according to the present invention is analyzed by using Time-Of-Flight Secondary Ion Mass Spectrometry (TOF-SIMS) with $Bi^{+}$ as primary ions, if the count ratio (A/B) which is a ratio of a count (A) of peaks that belong to $^{98}Mo_3S_7^{-}$ appearing near a mass number of 517.4 measured regarding the negative ion spectrum to a count (B) of peaks that belong to $^{40}Ca^{+}$ appearing near a mass number of 40.0 measured regarding the positive ion spectrum is 0.006 or higher or 0.01 or higher, an excellent low friction property is exhibited.

Therefore, on the assumption that the sliding surface according to the present invention is coated with the chromium-containing DLC film, it can be said that a reduction in the friction coefficient of friction between the sliding surfaces can be easily achieved as the lubricating oil according to the present invention has a higher Ca content and a lower amount of the trinuclear Mo compound (particularly, Mo compounds formed from $Mo_3S_7$). However, when the content of the added elements that may deteriorate the surface roughness of the covered surface is low, the content of the trinuclear Mo compound may be correspondingly reduced in a predetermined range.

DLC Film (1) Composition

It is preferable that the chromium-containing DLC film according to the present invention contains 1% to 49% or 3% to 29% of Cr in total when the entire film is assumed to be 100 at. % as described above. Too small an amount of Cr may not sufficiently function during the interaction with the trinuclear Mo compound, and too large an amount of Cr may cause difficulty in the formation of a good DLC film.

An H-free chromium-containing DLC film which does not substantially contain H or a low-hydrogen chromium-containing DLC film which has a low H content may exhibit both a low friction property and wear resistance to a high level. However, as the H amount in the film increases, the low friction property may further be enhanced. Here, it is preferable that the chromium-containing DLC film according to the present invention contains H in a proportion of 0% to 30% (the lower limit is higher than 0%, 0.1%, or 1%), 6% to 28%, or 10% to 26% when the entire film is assumed to be 100 at. %. When too large an amount of H is contained, the DLC film becomes excessively soft, and thus the wear resistance thereof may be degraded.

The DLC film according to the present invention may contain, in addition to the above-described elements, reforming elements which improve the sliding property and the like, or unavoidable impurities. The elements may include B, O, Ti, V, Mo, Al, Mn, Si, Cr, W, and Ni. Such elements may have any content, and it is preferable that the sum of the amounts of the elements in the DLC film is lower than 8 at. % or lower than 4 at. %. The composition of the DLC film may be homogeneous, may slightly change, or may also be inclined in the thickness direction.

(2) Structure and Property

The chromium-containing DLC film according to the present invention may have an amorphous structure as in a DLC film of the related art. However, the chromium-containing DLC film is not limited thereto and more preferably has a non-oriented structure.

The base material (or the base material of the sliding member) on which the DLC film is formed may be any material, and it is preferable that the DLC film is harder than the base material and has a lower elastic modulus than that of the base material. Accordingly, enhancement in the wear resistance, ductility, or impact resistance of the covered surface according to the present invention can be achieved. For example, it is preferable that the DLC film according to the present invention has a hardness of 15 GPa to 35 GPa, or 17 GPa to 30 GPa. When the hardness thereof is too low, the wear resistance is reduced, and when the hardness thereof is too high, cracking may easily occur in the DLC film. From the same point of view, it is preferable that the elastic modulus of the DLC film is, for example, 100 GPa to 200 GPa, or 130 GPa to 170 GPa.

(3) Film Forming Method

A method of forming the DLC film may be any method, and is preferably, for example, a sputtering method, and particularly, an unbalanced magnetron sputtering (UBMS) method because a dense DLC film is effectively formed.

It is preferable that before forming the DLC film, the chamber may be evacuated (preliminary evacuation) to $10^{-5}$ Pa or lower, or hydrogen gas may be introduced into the chamber to remove oxygen and moisture remaining in the chamber before the film formation. The amount of introduced hydrogen gas may be adjusted depending on the amount of H in the DLC film.

As the sputtering gas, for example, one or more types of noble gases such as argon (Ar) gas, helium (He) gas, and nitrogen ($N_2$) gas may be used. As a reaction gas containing H, one or more types of hydrocarbon gases such as methane ($CH_4$), acetylene ($C_2H_2$), and benzene ($C_6H_6$) may be used.

Regarding the gas flow rates, for example, the noble gas may have a flow rate of 200 sccm to 500 sccm, and the hydrocarbon gas may have a flow rate of 10 sccm to 25 sccm. In addition to the gases, $H_2$ gas may be introduced at a flow rate of 1 sccm to 25 sccm to reduce the incorporation of O or impurities into the film. In addition, the unit sccm is a flow rate at room temperature under atmospheric pressure (1013 hPa).

When the film forming temperature of the DLC film is 150° C. to 300° C., the generation of carbides can be suppressed, which is preferable. In addition, the film forming temperature is a surface temperature of the base material during the film formation and can be measured by a thermocouple or a heat-dissipation type thermometer.

Furthermore, it is preferable that the sputtering is performed under the conditions in which the gas pressure is 0.5 Pa to 1.5 Pa, the power applied to the targets (C target, Cr target) is 1 kW to 3 kW, and the intensity of a magnetic field in the vicinity of the base material (the sliding surfaces) is 6 mT to 10 mT. Moreover, a negative bias voltage of 50 V to 2000 V may also be applied to the base material.

Instead of the sputtering method, the DLC film may also be formed by an arc-ion plating (AIP) method. The AIP method is a method of forming a DLC film on the surface of a base material by generating arc discharge in vacuum and allowing C, Cr, and the like evaporated from the corresponding targets to react with processing gas in a reaction container.

Uses

The sliding machine of the present invention can be widely applied to various types of machines and apparatuses regardless of the specific form and uses. Particularly, the sliding machine of the present invention exhibits an ultralow friction property with which the friction coefficient of friction between the sliding surfaces is significantly reduced, and is thus appropriate for machines and the like that strictly require a reduction in sliding resistance and a reduction in the mechanical loss due to sliding. For example, the sliding machine of the present invention is appropriate for a driving system unit such as an engine or a transmission mounted in a vehicle or the like, a sliding body which forms a portion thereof, and the like. The sliding body mentioned here includes shafts and bearings, pistons and liners, meshing gears, pumps, and the like. Examples of a sliding member included in such sliding bodies include cams, valve lifters, followers, shims, valves, valve guides, and the like included in a valve system, and further include pistons, piston rings, piston pins, crankshafts, gears, rotors, rotor housings, and the like.

SUMMARY

Combinations of various test materials (sliding members) coated with DLC films which vary in doping metal elements (doping elements) and the contents thereof, and a lubricating oil (referred to as "lubricating oil A") which contains a trinuclear Mo compound (oil-soluble molybdenum compound) or a lubricating oil (referred to as "lubricating oil B") which does not contain the trinuclear Mo compound were subjected to a block on ring friction test. On the basis of the test results, the present invention will be described in more detail.

Production of Samples (1) Base Material

A plurality of block-shaped (6.3 mm×15.7 mm×10.1 mm) base materials made of quenched steel (JISSUS440C) were prepared. The surface (the covered surface of the DLC film) of each of the base materials was subjected to a mirror finish (a surface roughness Ra of 0.08 μm).

As a comparative sample (Sample C1 of Table 1) which was not coated with a DLC film, steel (JISSCM420) which was subjected to only a carburizing treatment was prepared. The carburized surface (a hardness of HV600) was subjected to a mirror finish to the same surface roughness.

(2) Formation of DLC Film

Test materials (Samples 10 to 15) in which DLC films that varied in doping elements and the H contents thereof as shown in Table 1 were formed on the surfaces of the corresponding base materials, and test materials (Samples 20 to 24) in which DLC films that varied in Cr contents as shown in Table 2 were formed were prepared.

(i) The formation of the DLC films containing doping elements was performed by using an unbalanced magnetron sputtering apparatus (UBMS504 made by KOBE STEEL, LTD.). Specifically, the formation was performed as follows. First, in order to ensure adhesion, before forming the DLC film, a Cr-based intermediate layer was performed on the surface of the mirror-finished base material. The intermediate layer was formed by evacuating the inside of the sputtering apparatus to $1\times10^{-5}$ Pa, thereafter sputtering a pure chromium target which was disposed to oppose the surface of the base material with Ar gas, and subsequently introducing $CH_4$ gas into the apparatus. The thickness of the intermediate layer was about 0.5 μm or greater. In addition, the distance between the surface of the base material according to each of the samples and the target surface was adjusted to be in a range of 100 mm to 800 mm. A film thickness mentioned in the present invention was specified from a wear track obtained by Calotest made by CSM Instruments (the same is applied hereinafter).

Next, various doping targets (pure metal of doping elements (Cr, Al, W, or V)) disposed to oppose the surfaces of the base materials and a graphite target were sputtered with Ar gas. Subsequent to this, Ar gas and $CH_4$ gas (hydrocarbon gas) were introduced into the apparatus. At this time, the sputtering output or the amount of each of the introduced gases was appropriately changed, thereby forming a DLC film having a desired composition. In this manner, test materials in which various DLC films (with a film thickness of 1 μm to 1.5 μm) were formed in the above-described intermediate layer were obtained. In addition, when the ratio (volume ratio) of the flow rates of $CH_4$ and Ar gases ($CH_4$/Ar) was about 5%, a hard chromium-containing DLC film was formed.

(ii) A DLC film (Sample 11 or Sample 20) which did not contain doping elements and had a high H content was formed by changing a doping target to C and introducing $CH_4$ gas. In addition, the H-free DLC film (Sample 10) was formed by an ion-arc plating method (cathodic-arc method) described in Japanese Patent Application Publication No. 2004-115826 (JP 2004-115826 A).

Measurement of Samples (1) Film Composition

The film composition of each of the DLC films was measured as follows. The doping elements in the films were measured by electron probe microanalysis (EPMA). H was measured by elastic recoil detection analysis (ERDA). ERDA is a method of measuring a hydrogen concentration by irradiating the film surface with a 2 MeV helium ion beam and detecting hydrogen that is kicked out of the film with a semiconductor detector. The composition of each of the DLC films obtained as described above was shown in both Table 1 and Table 2.

(2) Film Structure

A cross-sectional center portion of each of the DLC films in the thickness direction was irradiated with an electron beam by using a transmission electron microscope (TEM), and an electron beam diffraction image was obtained. A halo pattern was observed from each of the electron beam diffraction images, and thus it was confirmed that each DLC film had an amorphous structure.

(3) Surface Hardness and Surface Roughness

The surface hardness of each of the DLC films was obtained from a measurement value measured by a nanoindenter test machine (MTS made by TOYO Corporation). In addition, the surface roughness of each of the test materials mentioned in the specification was measured by a white light interferometry optical surface profiler (NewView 5022 made by Zygo Corporation) unless otherwise specified. The film property of each of the DLC films obtained as above is shown in both Table 1 and Table 2.

Lubricating Oil

As the lubricating oils used in the friction test, two types of engine oils shown in Table 3 were prepared. The lubricating oil A is made by using an engine oil (motor oil SN 0W-20 made by Toyota Motor Corporation) corresponding to the ILSAC GF-5 standard in the 0W-20 viscosity grade as the base, and adding and mixing a trinuclear Mo compound (appropriately and simply referred to as "trinuclear Mo material") described as "Trinuclear" in the disclosure material "Molybdenum Additive Technology for Engine Oil Applications" of Infineum International Ltd. to allow the Mo content with respect to the entire oil to correspond to 80 ppm Mo. On the other hand, the lubricating oil B is an engine oil based on no added or blended oil additives. Both the lubricating oils did not contain molybdenum dithiocarbamate (MoDTC).

Block on Ring Friction Test (1) Friction Coefficient

Combinations of the test materials and the lubricating oils were subjected to a block on ring friction test (simply referred to as "friction test"), and the friction coefficient (μ) of each of the sliding surfaces was measured. The friction coefficient of each of the test materials when the lubricating oil A containing the trinuclear Mo material was used was shown in both Table 1 and Table 2.

The friction test was performed by using each of the test materials as a block test piece with a sliding surface width of 6.3 mm, and using an S-10 standard test piece (with a hardness of HV800 and a surface roughness of 1.7 μm to 2.0 μm in terms of Rzjis) made by Falex Corporation formed from carburized steel (AIS14620) as a ring test piece (with an outer diameter of ϕ35 mm and a width of 8.8 mm). At this time, the friction test was performed at a test load of 133 N (a Hertz pressure of 210 MPa), a sliding speed of 0.3 m/s, and an oil temperature of 80° C. (constant) for 30 minutes, and the average value of μ for one minute immediately before the end of the test was determined as the friction coefficient of the test.

(2) Products on Sliding Surface

Figure 4:
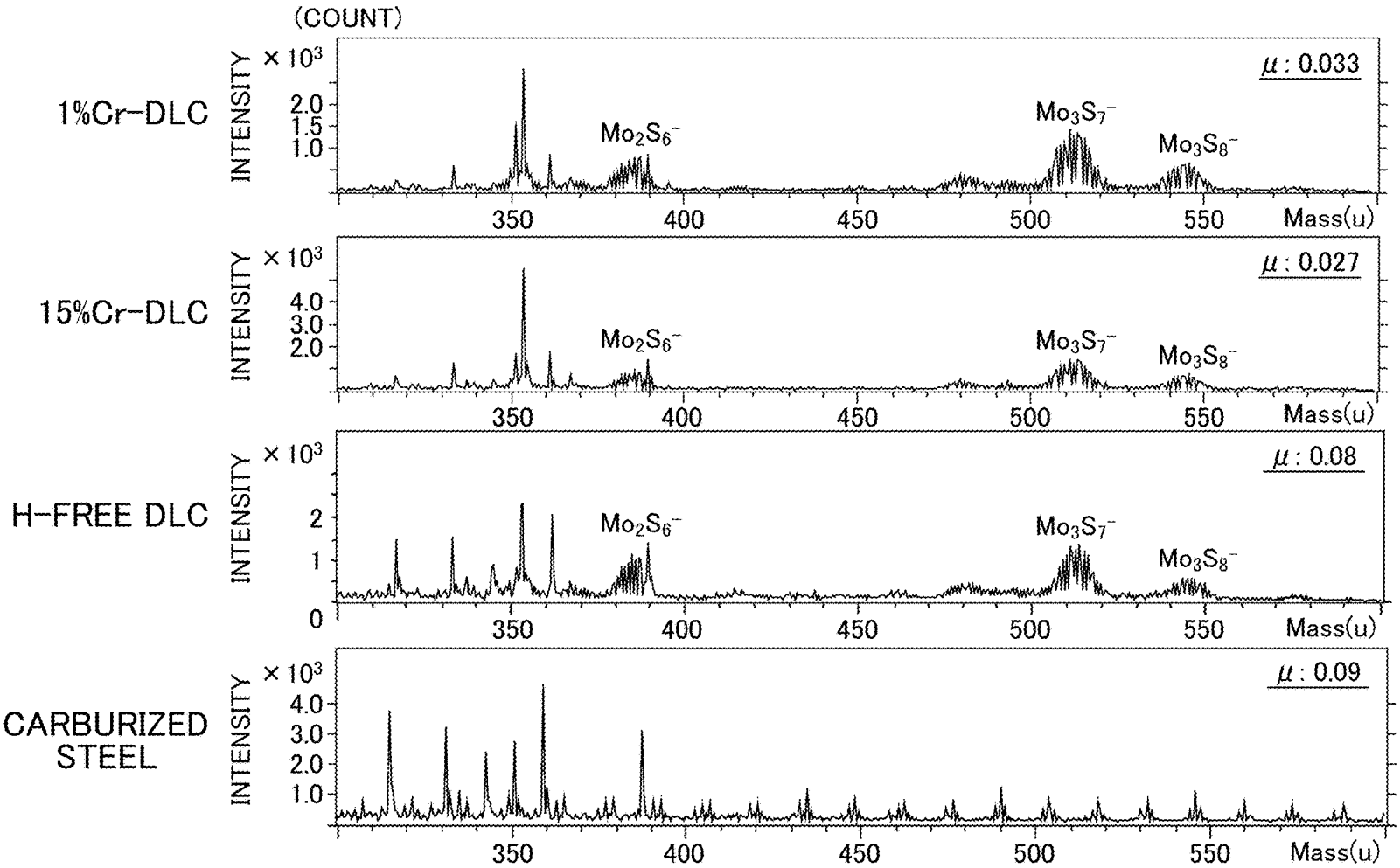
FIG. 4 is a spectrum graph focusing on negative ions near a mass number of 300 to 600 obtained by analyzing a sliding surface after a friction test is performed by using the lubricating oil containing the trinuclear Mo compound, through TOF-SIMS.

The sliding surface of each of the test materials after the friction test was measured by Time-Of-Flight Secondary Ion Mass Spectrometry (TOF-SIMS). By using TOF-SIMS 5 made by ION-TOF, high-resolution spectrum measurement was performed on a measurement area of 100 μm×100 μm on the sliding surface, with 30 keV Bi+ beams as primary ions. Representative secondary ion mass spectra obtained through the measurement are shown in FIG. 4. In FIG. 4, the μ values obtained by the friction test were added. In addition, all of the spectra shown in FIG. 4 were also measured from the sliding surfaces after the friction test using the lubricating oil A.

(3) Wear of Sliding Surface

The sliding surface of each of the test materials after the friction test using the lubricating oil A was measured by the above-mentioned optical surface profiler. The stereoscopic shapes (wear depths) of the sliding surfaces obtained in this manner are collectively shown in FIG. 7.

Evaluations (1) Friction Property

First, the friction coefficients when the DLC films that varied in doping elements and the lubricating oil A (containing the trinuclear Mo material) were combined are shown in FIG. 1. It can be seen that the friction coefficient of the chromium-containing DLC film was significantly lower than the friction coefficients of other DLC films and the friction coefficient of carburized steel that does not have a DLC film.

Figure 2:
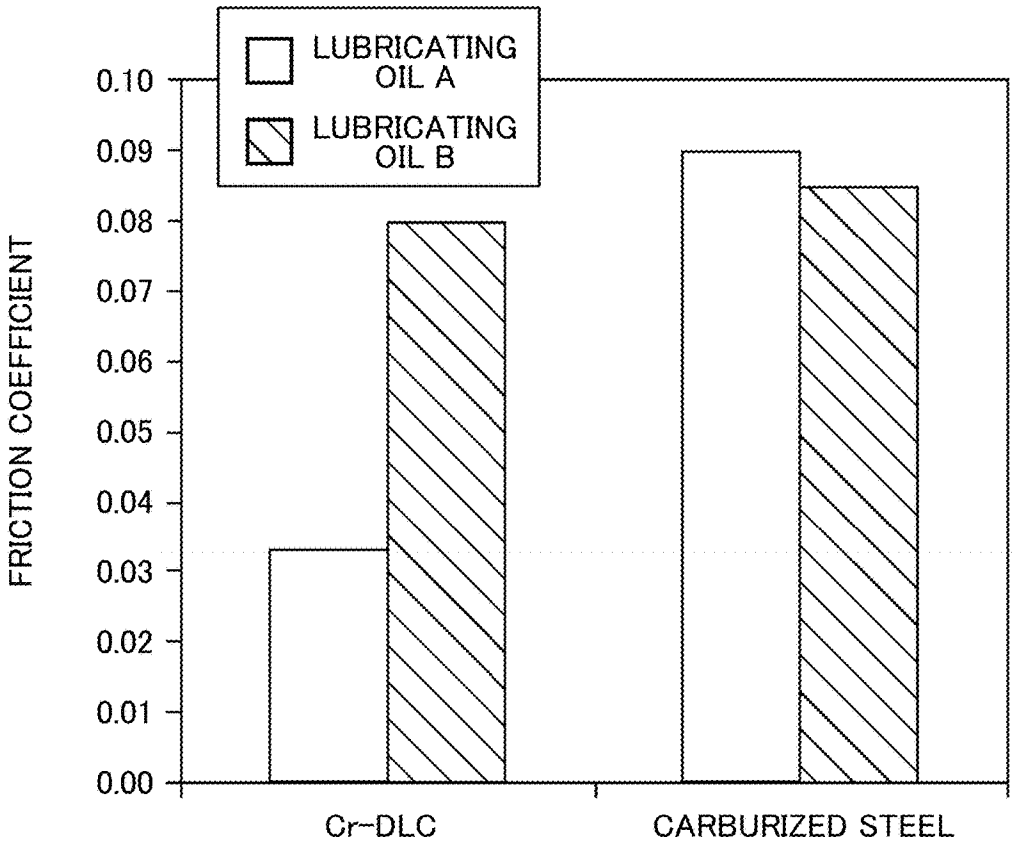
FIG. 2 is a bar graph showing the friction coefficient of each test material in a case where the lubricating oil containing the trinuclear Mo compound or a lubricating oil that does not contain the trinuclear Mo compound is used.

In addition, the friction coefficients when the chromium-containing DLC film or the carburized steel and the lubricating oil A or the lubricating oil B (that does not contain the trinuclear Mo material) were combined are shown in FIG. 2. In the case of the carburized steel, the friction coefficient thereof was rarely changed even when any lubricating oil was used. Contrary to this, in the case of the chromium-containing DLC film (13 at. % of Cr), the friction coefficient when the lubricating oil A was used was significantly lower than the friction coefficient when the lubricating oil B was used. From this, it became apparent that by a combination of the chromium-containing DLC film and the lubricating oil containing the trinuclear Mo material, a specific ultralow friction property is exhibited.

Figure 3:
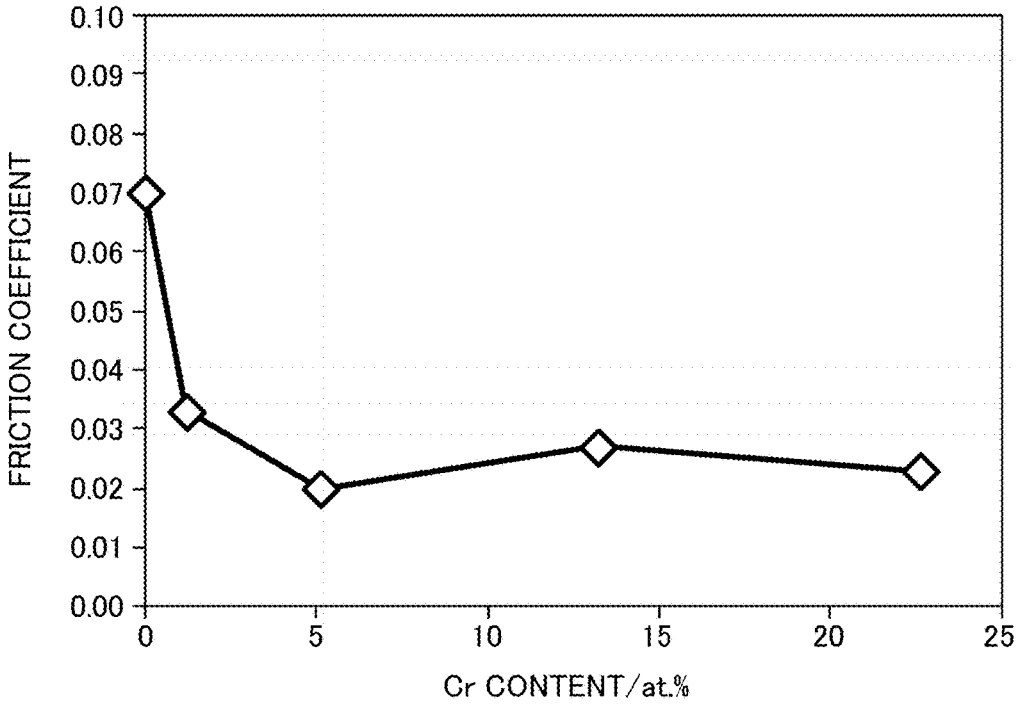
FIG. 3 is a graph showing the relationship between the Cr content in a DLC film and the friction coefficient in a case where the lubricating oil containing the trinuclear Mo compound is used.

Next, from the results obtained as described above, the relationship between the Cr content in the chromium-containing DLC film and the friction coefficient when the lubricating oil A was used is shown in FIG. 3. As is apparent from FIG. 3, it could be seen that the friction coefficient can be sufficiently reduced only by including 1 at. % or higher (or 3 at. % or higher) of Cr in the DLC film. In addition, it was also seen that even when the Cr content is 22 at. % or higher, an ultralow friction property is exhibited. From this, it could be seen that an ultralow friction property when the lubricating oil containing the trinuclear Mo material and the chromium-containing DLC film are combined can be stably exhibited while not being significantly affected by the Cr content in the DLC film.

(2) Products on Sliding Surface

As is apparent from the analysis results of TOF-SIMS shown in FIG. 4, in the case of the chromium-containing DLC film (13 at. % of Cr) and the H-free DLC film, fragments of MoxSy such as —$Mo_3S_7$ and —$Mo_3S_8$ were detected from the sliding surface after the friction test using the lubricating oil A, and thus the adsorption of the trinuclear Mo material was confirmed. On the other hand, in the case of the carburized steel, the adsorption of the trinuclear Mo material was not recognized.

From the analytical results of TOF-SIMS, further examination was performed, and it could be seen that the secondary ion mass spectrum amount regarding $^{40}Ca^+$ was different between the chromium-containing DLC film and the H-free DLC film. Specifically, it became apparent that the $^{40}Ca^+$ spectrum intensity of the chromium-containing DLC film was significantly lower than that of the H-free DLC film. This means that the amount of Ca compounds that adhered to the sliding surface or were generated after the friction test in the chromium-containing DLC film was lower than that of the H-free DLC film. In addition, it is thought that Ca is a component derived from overbased calcium sulfonate that is frequently mixed to impart an acid neutralization action or a deposit cleaning action to an engine oil.

Figure 5:
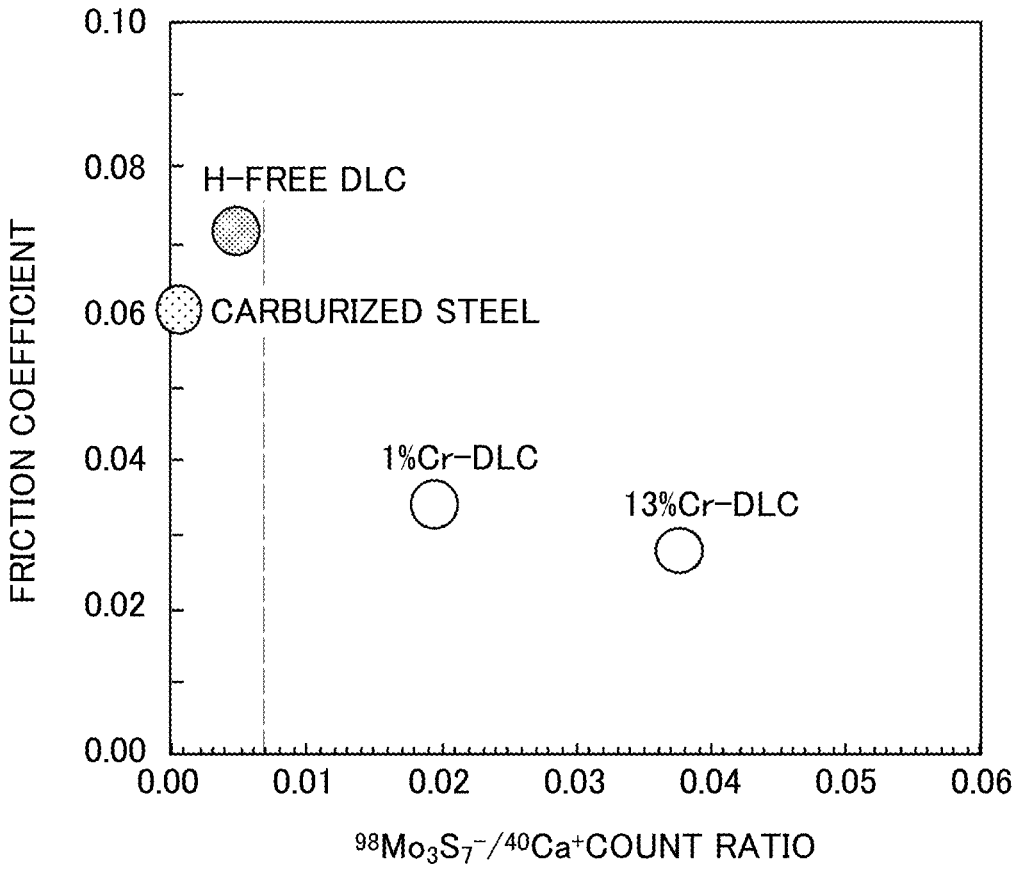
FIG. 5 is a diagram showing the relationship between the count ratio (A/B) between $^{40}Ca^{+}$ and $^{98}Mo_3S_7^{-}$ obtained on the basis of the spectrum graph, and the friction coefficient.

From the results, it is thought that the reason why the chromium-containing DLC film exhibits an ultralow friction property unlike other DLC films when the lubricating oil A is used is that the trinuclear Mo material adsorbs onto the sliding surface and thus the adsorption and generation of Ca compounds is suppressed. In order to measure the effect of the trinuclear Mo material and the Ca compounds on the friction coefficient, the relationship between the count ratio ($Mo_3S_7^-/^{40}Ca^+$) between $Mo_3S_7^-$ and $^{40}Ca^+$ and the friction coefficient is shown in FIG. 5. As is apparent from FIG. 5, it can be said that when the count ratio is 0.006 or higher, 0.01 or higher, or 0.015 or higher, the friction coefficient is significantly reduced.

In summary, when a sliding member in which the sliding surface is coated with a chromium-containing DLC film is used in the presence of a lubricating oil containing the trinuclear Mo material, molybdenum sulfide compounds (trinuclear Mo materials such as $Mo_3S_7$ and $Mo_3S_8$) adsorb onto the sliding surface. It is thought that the molybdenum sulfide compounds have a similar layered structure to that of $MoS_2$ and the low shear property thereof contributed to a reduction in the friction coefficient described above.

Furthermore, in a case where the Ca-based additive (overbased calcium sulfonate or the like) is mixed with the lubricating oil, the molybdenum sulfide compounds prevent Ca compounds that may cause an increase in the friction coefficient from adsorbing onto the sliding surface and being generated. It is thought that this also contributed to a reduction in the friction coefficient described above.

The surface roughnesses of all of the chromium-containing DLC films according to Examples were Ra 0.01 μm to 0.02 μm and were in a very smooth state. Accordingly, it is thought that the effect of reducing the friction coefficient described above was stably exhibited immediately after the start of sliding.

(3) Wear Resistance

Figure 6:
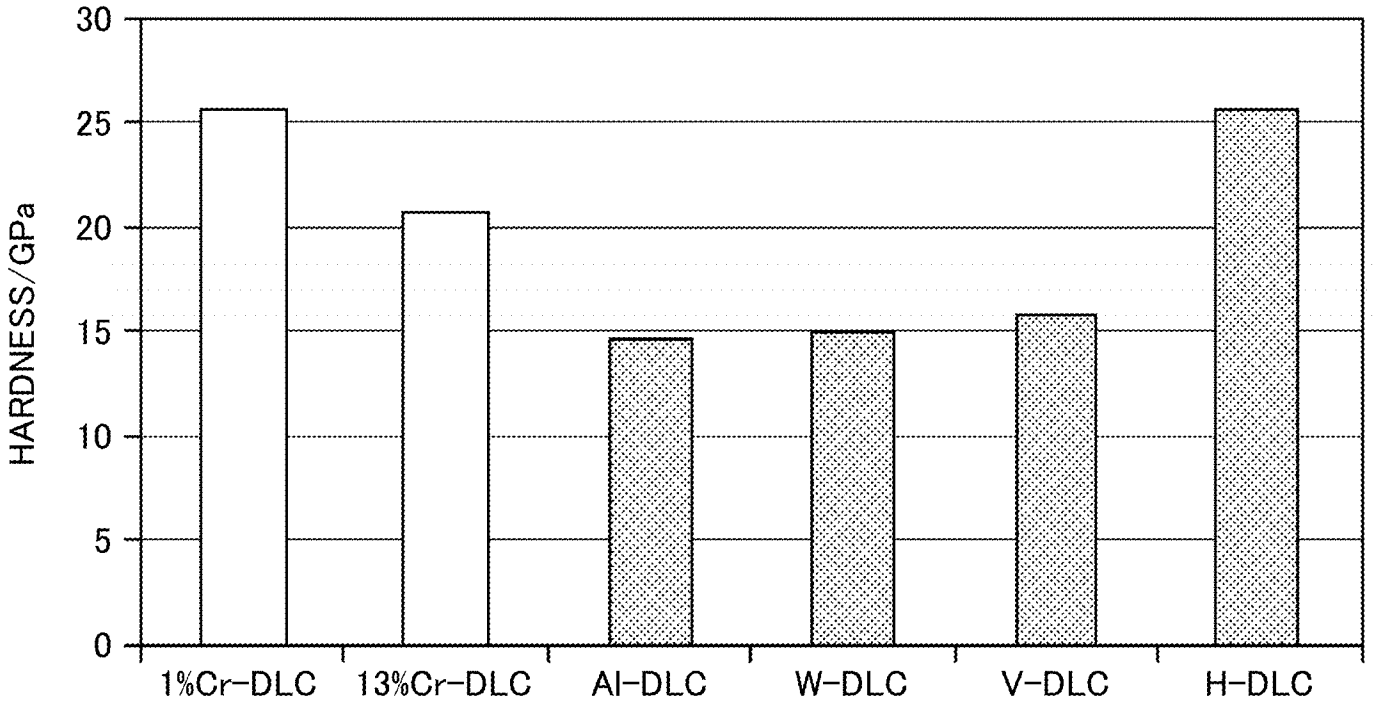
FIG. 6 is a bar graph showing the surface hardness of each DLC film.

The hardnesses of the DLC film that varied in doping elements are shown in FIG. 6 in contrast with each other. As is apparent from FIG. 6, the chromium-containing DLC film is sufficiently harder than the DLC films containing other doping elements and has the same degree of hardness as that of the H-DLC film. It is thought that since the H contents of the DLC films are at the same degree, the hardnesses of the DLC films depend on the types of the doping elements.

Figure 7:
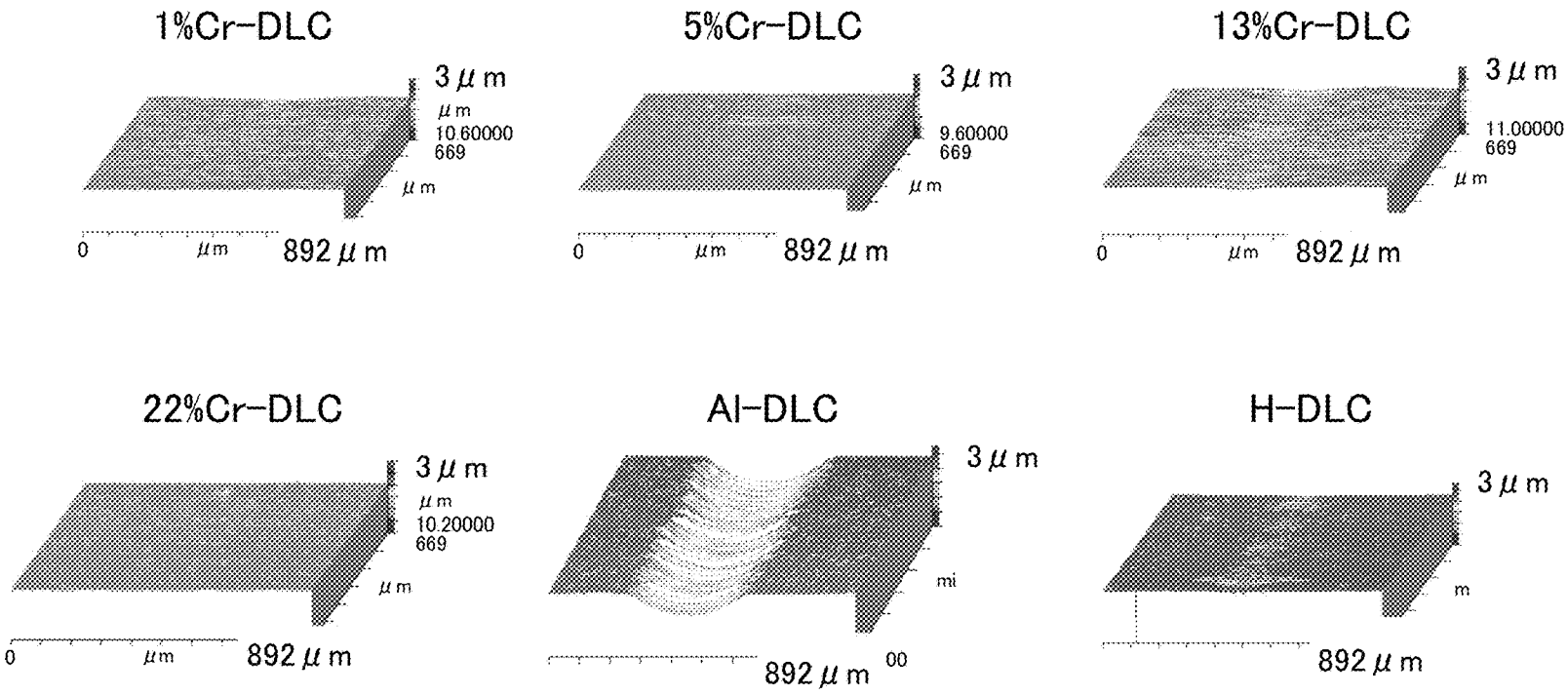
FIG. 7 is a stereoscopic diagram showing the sliding surface of each test material after the friction test is performed by using the lubricating oil containing the trinuclear Mo compound.
Figure 8:
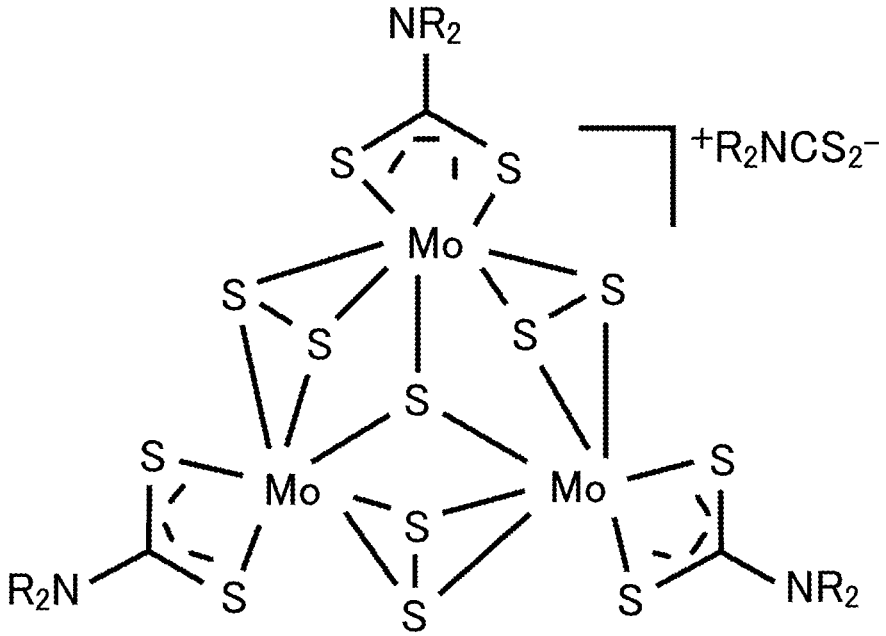
FIG. 8 is a molecular structural diagram showing an example of the trinuclear Mo compound according to the present invention.

It was seen from FIG. 7 which illustrates the sliding surfaces after the friction test that the chromium-containing DLC film rarely wears and exhibits excellent wear resistance regardless of the Cr content.

As described above, although the reason that the chromium-containing DLC film is excellent in wear resistance with a high hardness is not necessarily clear, it is thought that one of the reasons is that chromium carbide (CrC) which is hard and fine strengthened particles are uniformly dispersed in the DLC which is a matrix and the CrC is consistent with the matrix (DLC). In addition, the state of the CrC dispersed in the DLC film can be checked through TEM or the like.

What is claimed is:

1. A sliding machine comprising:

a pair of sliding members having sliding surfaces that oppose each other and are able to move relative to each other; and a lubricating oil interposed between the opposed sliding surfaces, wherein at least one of the sliding surfaces is formed of a covered surface covered with an amorphous carbon film containing 3 at. % to 20 at. % of chromium (Cr) relative to the total concentration of 100 at. % of the components of the amorphous carbon film and 5 at. % to 28 at. % of H, and wherein the lubricating oil contains an oil-soluble molybdenum compound having a chemical structure formed from a trinuclear material of molybdenum (Mo), the lubricating oil contains 10 ppm to 500 ppm of the oil-soluble molybdenum compound in terms of Mo mass ratio with respect to an entirety of the lubricating oil, and the amorphous carbon film has a hardness of 15 GPa to 35 GPa.

2. The sliding machine according to claim 1, wherein the amorphous carbon film further contains carbon (C) and impurities as a remainder relative to the total concentration of 100 at. % of the components of the amorphous carbon film.

3. The sliding machine according to claim 1, wherein the trinuclear material is formed from at least one of $Mo_3S_7$ and $Mo_3S_8$.

4. The sliding machine according to claim 1, wherein, when an outermost surface of the covered surface is ana-

TABLE 1

| Sample No. | Sample name | Production method | Film composition (remainder: C) (at. %) Doping element | H | Film property Hardness (GPa) | Surface roughness Ra (μm) | Friction coefficient (in lubricating oil containing trinuclear Mo) | Note |
|---|---|---|---|---|---|---|---|---|
| 10 | H-free DLC | Arc ion plating | — | 0.3 | 49.0 | 0.045 | 0.08 | |
| 11 | H-DLC | Sputtering | — | 20 | 25.7 | 0.013 | 0.07 | Same as Sample 20 |
| 12 | Cr-DLC (13%Cr-DLC) | | Cr: 13.2 | 20 | 20.7 | 0.015 | 0.027 | Same as Sample 23 |
| 13 | Al-DLC | | Al: 14 | 15 | 14.6 | 0.014 | 0.063 | |
| 14 | W-DLC | | W: 4 | 15 | 15.0 | 0.018 | 0.062 | |
| 15 | V-DLC | | V: 9 | 12 | 15.7 | 0.016 | 0.065 | |
| C1 | Carburized steel | — | | — | (HV 600) | (0.08) | 0.09 | SCM420 (without DLC film) |

TABLE 2

| Sample No. | Sample name | Composition of DLC film (at. %/remainder: C) Cr | H | Hardness (GPa) | Friction coefficient (in lubricating oil containing trinuclear Mo) |
|---|---|---|---|---|---|
| 20 | H-DLC | 0 | 20 | 25.7 | 0.07 |
| 21 | 1% Cr-DLC | 1.2 | 25 | 25.7 | 0.033 |
| 22 | 5% Cr-DLC | 5.1 | 21 | 17.4 | 0.020 |
| 23 | 13% Cr-DLC | 13.2 | 19.6 | 20.7 | 0.027 |
| 24 | 23% Cr-DLC | 22.6 | 18.6 | 17.4 | 0.023 |

TABLE 3

| Lubricating oil name | Presence or absence of trinuclear Mo compound | Composition of lubricating oil (remainder: base oil) (ppm) Mo | S | Zn | P | N | B | Ca | Na | Si |
|---|---|---|---|---|---|---|---|---|---|---|
| Lubricating oil A | Present (80 ppm) | 80 | 2400 | 700 | 630 | 500 | 16 | 2000 | 0 | 4 |
| Lubricating oil B | Absent | 130 | 1800 | 730 | 690 | 900 | 4 | 1760 | 360 | 4 |

lyzed by using time-of-flight secondary ion mass spectrometry (TOF-SIMS) with $Bi^+$ as primary ions, a count ratio (A/B) which is a ratio of a count (A) of peaks that belong to $^{98}Mo_3S_7^-$ appearing near a mass number of 517.4 measured regarding a negative ion spectrum to a count (B) of peaks that belong to $^{40}Ca^+$ appearing near a mass number of 40.0 measured regarding a positive ion spectrum is 0.006 or higher.

* * * * *